United States Patent [19]

Tokumasu et al.

[11] Patent Number: 4,918,832

[45] Date of Patent: Apr. 24, 1990

[54] LAMINATED IRON CORE ASSEMBLING PROCESS

[75] Inventors: Osamu Tokumasu; Yoshihiro Kuzuha; Hirosi Suzuki; Bunichiro Awata, all of Ako, Japan

[73] Assignee: Mitsubishi Denki Kabushiki Kaisha, Japan

[21] Appl. No.: 315,264

[22] Filed: Feb. 24, 1989

[30] Foreign Application Priority Data

Feb. 24, 1988 [JP] Japan ..... 63-39352

[51] Int. Cl.[5] ..... H01F 41/02

[52] U.S. Cl. ..... 29/606; 29/609; 336/217

[58] Field of Search ..... 29/605, 609, 606; 336/217

[56] References Cited

U.S. PATENT DOCUMENTS 4,283,842 8/1981 De Laurentis et al. ..... 29/606

4,404,740 9/1983 Hagg et al. ..... 29/606

*Primary Examiner*—Carl E. Hall

*Attorney, Agent, or Firm*—Leydig, Voit & Mayer

[57] ABSTRACT

A process is provided for assembling a laminated iron core on a support structure about an electric coil from a plurality of laminations to form a shell-type transformer core. According to the process, the plurality of lamination sections are stacked in a staggered relationship to form a first core section which has joint ends to form overlapping joints between an adjacent core section. The first core section is stacked by placing a slider sheet of a low coefficient of friction on a first support member and stacking the lamination sections on the slider sheet. The first core section is then conveyed onto the support structure at which the iron core is to be assembled, and the slider sheet is pulled out to cause the first core section to directly sit on the support structure. The plurality of lamination sections are inserted between the joints on site to form a second core section which connects the joint ends of the first core section to define a magnetic circuit around the coil.

10 Claims, 6 Drawing Sheets

LAMINATED IRON CORE ASSEMBLING PROCESS

BACKGROUND OF THE INVENTION

This invention relates to a process for assembling a laminated iron core and, more particularly, to a process for assembling a laminated iron core having overlapping joints on a support structure about an electric coil of a shell-type transformer core.

FIGS. 1 and 2 illustrate a typical shell-type electrical transformer to which the present invention can be applied. In the figure, the transformer comprises a lower tank 1 having a flange 2 at its upper open end. An electrical coil 3 having a coil window 4 is inserted at its bottom in the lower tank 1. The upper portion of the coil 3 projects and is above the lower tank 1. A support beam 5 having an inverted T-shaped cross section is mounted on the lower edge of the window 4 of the coil 3 and on the flange 2 of the lower tank 1. Lower spacers 6 are also mounted on the flange 2.

The transformer further comprises two laminated iron cores 7 disposed on the support beam 5 and the spacers 6 around the legs of the coil 3. A wedge 8 is inserted between the top ends of the iron cores 7 and the upper edge of the window 4 of the coil 3. Upper spacers 9 are disposed between the top ends of the iron cores 7 and core support beams 11 disposed around the coil 3 and mounted to an upper tank 10. The upper tank 10 is attached to the flange 2 of the lower tank 1 by a flange 12.

According to the conventional assembling process, the transformer thus constructed is assembled by first inserting the lower portion of the coil 3 into the lower tank 1 with the coil legs protruding from the lower tank 1. Then, the support beam 5 is placed on the lower edge of the coil window 4 so that the opposite ends are mounted on the flange 2 of the lower tank 1. The spacers 6 are placed on other portion of the flange 2 around the coil 3.

A plurality of laminations or sheets of magnetic material *7a, 7b* and *7c* are placed and stacked on the spacers 6 and the support beam 5 one by one until the stack reaches a predetermined height to form a substantially rectangular iron core having overlapping joints *7d* as shown in FIGS. 1 and 2. During this process, since each of frame-shaped layers of the magnetic sheets is composed of four substantially trapezoidal sections of a magnetic sheet material, four trapezoidal sections must be precisely placed so that the slanted sides abut each other to form the first frame-shaped layer. The second layer is similarly prepared by arranging four trapezoidal sections on the first layer, but with the slanted sides of the trapezoidal sections of the second layer brought into an overlapping relationship with those of the first layer. As is well known this arrangement provides the overlapping joints in which the slanted sides of the sections are staggered by each sheet.

Then, the wedge 8 is inserted between the top lamination of the iron cores and the upper edge of the coil window 4 of the coil 3 and the spacers 9 are provided so that the assembled iron cores 7 are firmly held in their respective positions within the tank by the core support beams 11.

According to the conventional assembling process as above described, each of a large number of the lamination sections are manually precisely positioned one by one with a great care so that the already stacked sections are not dislocated. Also, at each time the stacking of a single layer is finished, the stacked sections must be re-positioned. Therefore, stacking of the lamination sections into a laminated iron core is difficult and time-consuming.

SUMMARY OF THE INVENTION

Accordingly, one object of the present invention is to provide a process for assembling a laminated iron core for a static induction apparatus which can be simply and easily carried out.

Another object of the present invention is to provide a process for assembling a laminated iron core for a static induction apparatus which allows the iron core to be assembled in a short time.

Another object of the present invention is to provide a process for assembling a laminated iron core for a static induction apparatus which allows the assembled iron core to be precise.

With the above objects in view, the present invention provides a process for assembling a laminated iron core on a support structure about an electric coil from a plurality of laminations to form a magnetic core for a shell-type static induction apparatus. According to the process, the plurality of laminations are stacked in a staggered relationship to form a first core section which has joint ends to form overlapping joints between an adjacent core section. The first core section may be stacked by placing a slider sheet of a low coefficient of friction on a first support member and stacking the laminations on the slider sheet. The first core section is then conveyed onto the support structure at which the iron core is to be assembled. When the slider sheet is used, it is pulled out to cause the first core section to directly sit on the support structure. The plurality of laminations are inserted between the joints in site to form a second core section which connects the joint ends of the first core section to define a magnetic circuit around the coil.

BRIEF DESCRIPTION OF THE DRAWINGS

The present invention will become more readily apparent from the floowing detailed description of the preferred embodiment of the present invention taken in conjunction with the accompanying drawings, in which.

DESCRIPTION OF THE PREFERRED EMBODIMENTS

Figure 2:
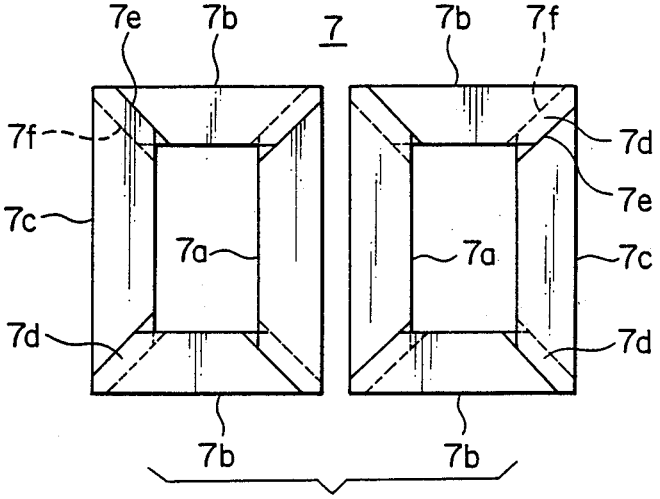
FIG. 2 is a schematic plan view of the laminated iron core looking along the line II—II of FIG. 1 for illustrating the structure of the core.

As best seen from FIG. 2, the magnetic core 7 of a shell-type transformer comprises a large number of substantially rectangular, frame-shaped laminations or layers of a magnetic material each including an inner leg section *7a*, an outer leg section *7c* and a pair of shorter yoke sections *7b*. The lamination sections *7a*, *7b* and *7c* are substantially trapezoidal in shape and their sloped ends are arranged in an abutting relationship with the sloped ends of the adjacent lamination section so that four lamination sections *7a*, *7b* and *7c* are all in the same plane to form a single frame-shaped lamination or layer jointed at each corner. In FIG. 2, it is seen that the topmost lamination has joints *7e* and the second lamination under the topmost lamination has joints *7f* staggered with respect to the joints *7e* to form the overlapping joints *7d*.

According to the present invention, the laminated iron core 7 is assembled on the support structure of the static induction apparatus such as the support beam 5, the spacers 6 and the lower tank flange 2 about the electric coil 3 from a plurality of laminations to form a shell-type transformer core.

Figure 1:
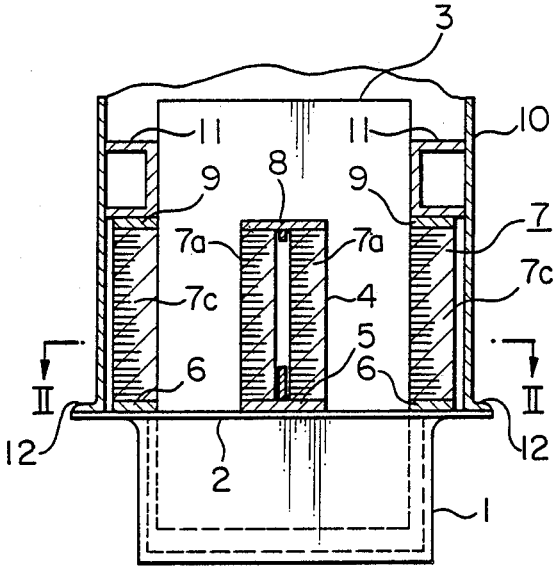
FIG. 1 is a vertical cross sectional view of a typical shell-type transformer.
Figure 3:
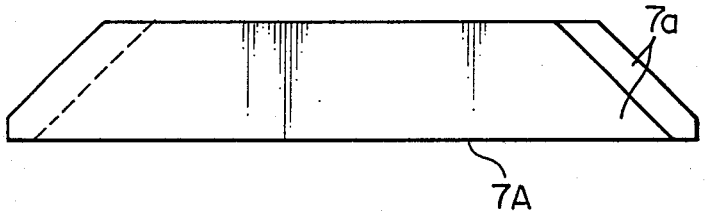
FIG. 3 is a plan view of a core section comprising a plurality of substantially trapezoidal laminations stacked one on the other in a staggered relationship.
Figure 4:
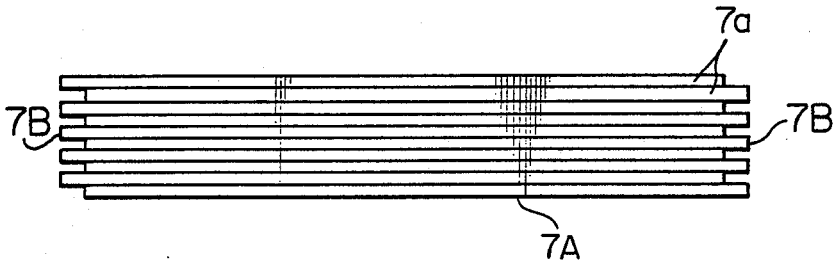
FIG. 4 is a side view of the core section shown in FIG. 3.

The assembly is achieved by first stacking, as shown in FIGS. 3 and 4, the plurality of lamination sections *7a* which are the trapezoidal sheets in a staggered relationship in the longitudinal direction to form a first core section 7A which has joint ends 7B for forming, at the later stage, the overlapping joints *7d* shown in FIG. 2 between the adjacent core sections 7A. In order to assemble iron core shown in FIGS. 1 and 2, four of these first iron core sections 7A are prepared.

Figure 5:
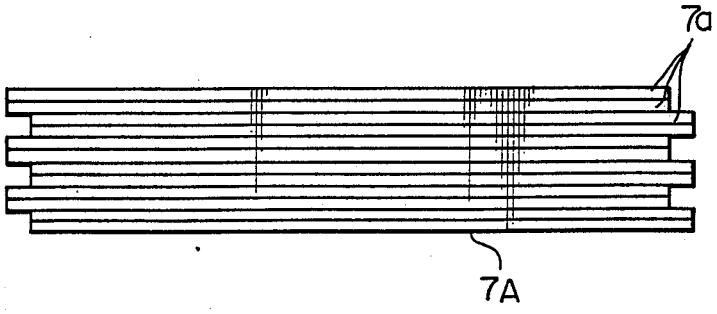
FIG. 5 is a side view of another embodiment of the core section in which the laminations are staggered two by two.

In the illustrated embodiments, since the iron core structure to be assembled by the present invention is the shell-type core, the stacked core section 7A is a leg of the iron core. Also, while FIG. 4 shows that each of the lamination sections *7a* of the first core section 7A is staggered one by one in the longitudinal direction, any desired number of lamination sections *7a* may be grouped and each of the groups of the lamination sections *7a* can be arranged as a unit in the staggered relationship as shown in FIG. 5 in which the group contains two lamination sections *7a*.

Figure 6:
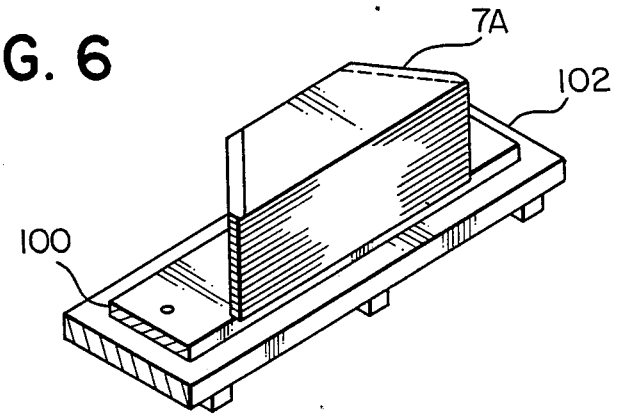
FIG. 6 is a perspective view illustrating the manner in which the stacked core section is placed on the slider member supported by the support member.

In the preferred embodiment shown in FIG. 6, for the convenience of the following step, a support member 102 for supporting the stacked core section 7A is prepared and a slider sheet 100 of a low coefficient of friction is placed on the support member 102. Then, the lamination sections *7a* are stacked on the slider sheet 100 until they form the stacked core section 7A.

Figure 7:
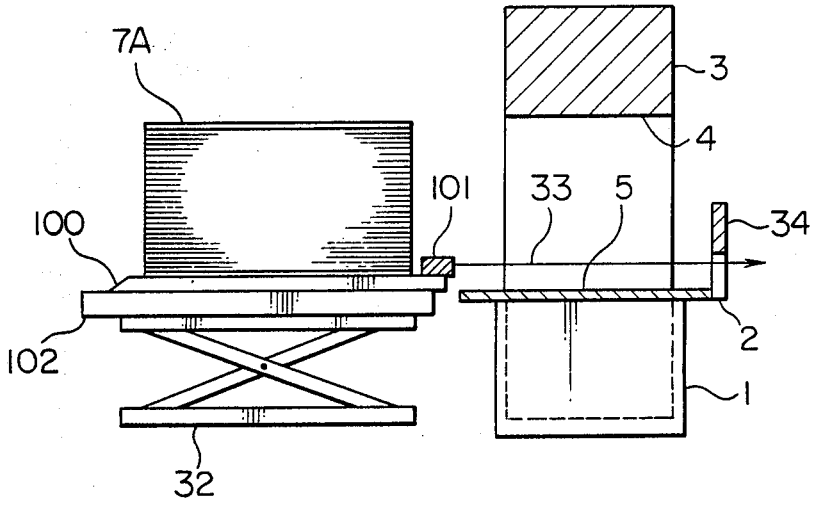
FIG. 7 is a side view showing a manner in which the stacked iron core section is conveyed and placed on the support structure of the transformer.

Then, as shown in FIG. 7, the support member 102 is carried together with the core section 7A on the slider sheet 100 by any suitable conveying means such as a table lift 32 to a position close to the support beam 5 on the flange 2 of the transformer tank 1. The slider sheet 100 is pulled by a winch wire 33 connected at 101 to the slider sheet 100 so that the slider sheet 100 as well as the first core section 7A is conveyed onto the support structure such as the flange 2 and the support beam 5 of the transformer. In order to stop the stacked core section 7A at the desired position on the support structure, a stopper 34 is provided to be relatively stationary with respect to the support structure. Therefore, when the slider sheet 100 is pulled even after the core section 7A on it abuts against the stopper 34, the slider sheet 100 can be further pulled to be removed from between the support member 102 and the stacked core section 7A. Thus, the first core section 7A can be precisely positioned on the support structure at positions at which they are finally mounted.

Then, a plurality of sheets of the lamination sections *7b* are manually inserted between two adjacent first core sections 7A so that the slanted joint ends of the respective lamination sections *7b* are inserted into corresponding gaps defined between two protruding ends of the staggered overlapping joints. This inserting step is carried out until the joint ends of the first core sections 7A placed in position around the coil 3 are magnetically connected to define a magnetic circuit around the coil 3.

Figure 8:
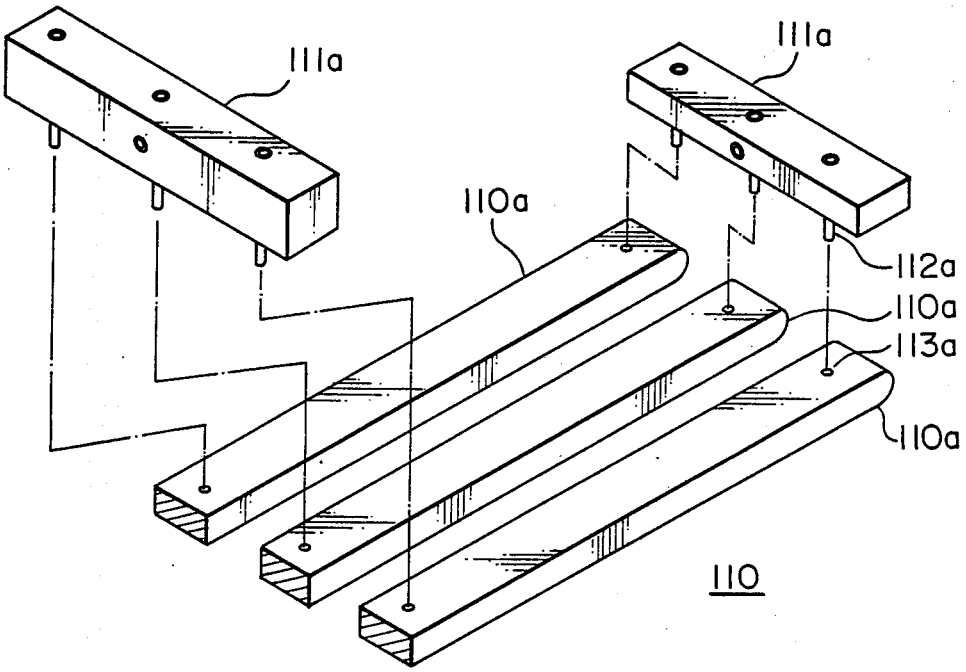
FIG. 8 is an exploded perspective view of one example of a support member.

FIG. 8 illustrates a support member 110 which can be used in place of the support member 102 shown in FIGS. 6 and 7. The support member 110 is basically a framework comprising three parallel longitudinal members 110*a* and two transverse end members 111*a* assembled by pins 112*a* and bores 113*a* in a rectangular framework. With this arrangement, the outer dimensions of the framework can very easily be modified according to the dimension of the stacked core section 7A to be stacked and conveyed on the support member 110.

Figure 9:
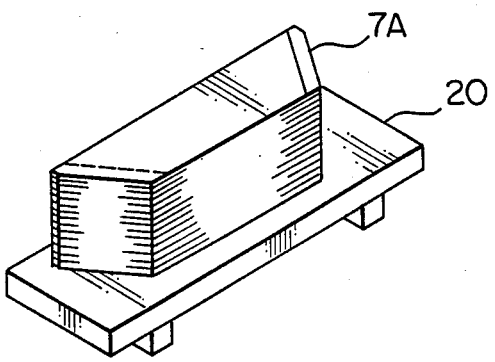
FIGS. 9 and 10 are perspective views illustrating another step of preparing a sub-assembly of the core section in which the iron core section on the slider member is placed on the support member.
Figure 10:
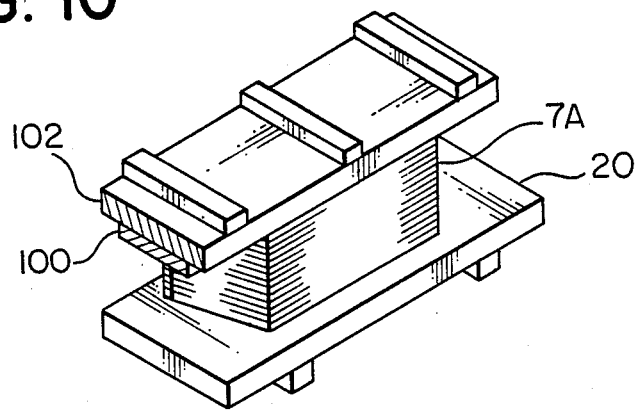

FIGS. 9 and 10 show another method for conveying the stacked core section 7A by first stacking the laminations *7a* until the core section 7A is obtained on a second support member 20 as shown in FIG. 9. Then, the slider sheet 100 is placed on the stacked core section 7A and the first support member 102 is placed on the slider sheet 100 as shown in Fig. 10. Thus, there is provided a sub-assembly of the first core section 7A and the slider sheet 100 sandwiched between the first and the second support members 102 and 20. The first and the second support members 102 and 20 are fastened together by suitable fastening means such as bolts and nuts. The entire structure thus fastened is then turned upside down so that the first support member 102 and the slider sheet 100 support the bottom surface of the stacked core section 7A and the second support member 20 support the top surface of the stacked core section 7A.

The second support member 20 on the top of the stacked core section 7A can be removed from the stacked core section 7A so that the same assembly as shown in FIG. 6 is obtained. This assembly may be conveyed onto the support structure of the transformer in the same way as explained in connection with the embodiment shown in FIG. 7.

Figure 11:
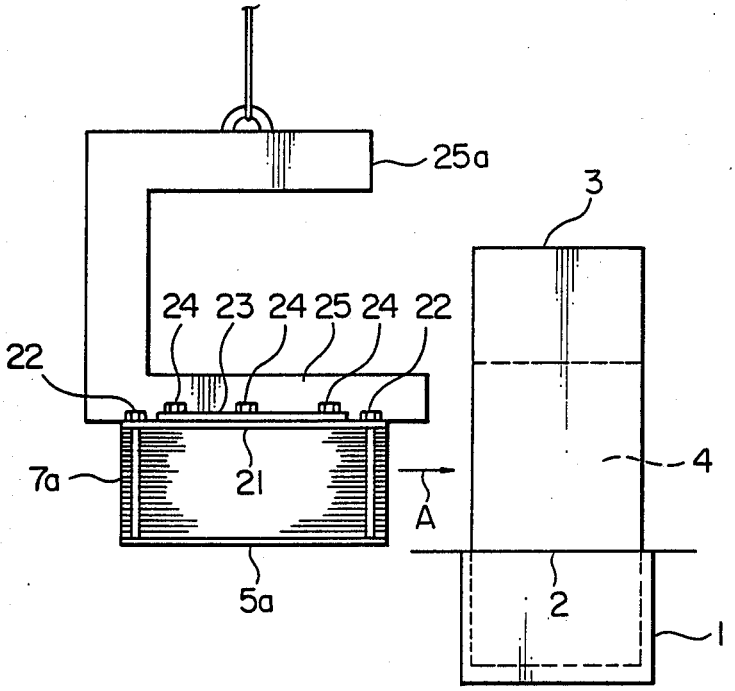
FIG. 11 is a side view illustrating another example of the step of conveying and placing the core section sub-assembly on the coil support structure.

FIG. 11 illustrates another example of conveying the stacked core section 7A onto the support structure of the transformer. In this example, the stacked core section 7A is sandwiched between the first and the second support members 5*a* and 21 and is clamped between them by bolts 22. The bolts 22 extend through the second support member 21 and screwed into the first support member 5a to form a rigid assembly. The first support member 5a in this embodiment can also be used as the spacer such as the support beam 5 shown in FIG. 1 after the stacked core section 7A is placed on the transformer support structure. The second support member 21 of the assembly is attached by bolts 24 to support plate 23 secured to an elongated beam 25. The elongated beam 25 is supported at its one end by a frame 25a so that the beam 25 can be inserted, together with the stacked core section 7A attached thereto, within the window 4 of the coil 3 so that the stacked core section may be conveyed and placed onto the support structure of the transformer by moving the elongated beam 25. The frame 25a is supported from a crane (not shown).

The beam 25 together with the stacked core section 7A is then inserted into the coil window 4 as shown by an arrow A and lowered on the support structure including the first support member 5a on the position at which they are to be mounted. After the elongated beam 25, together with the upper, second support member 21, is removed from the stacked core section 7A seated on the transformer support structure, additional laminations 7a are stacked on the stacked core section 7A until the overall height of the stacked core section 7A reached a predetermined dimension and substantially fill the coil window 4. Then, after the yoke section 7b is assembled by inserting the laminations one by one into the gaps in the overlapping joints 7d, the spacers 9 and the wedge 8 are inserted between the top lamination 7a of the core section 7A and the upper edge of the coil window 4 to firmly secure the iron core with respect to the tank 1 and the coil 3.

Figure 12:
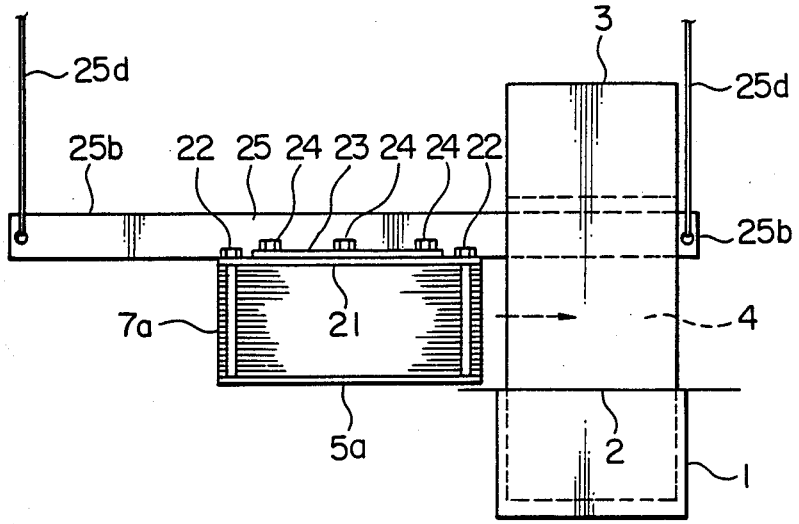
FIG. 12 is a side view illustrating still another example of the step of conveying and placing the core section sub-assembly on the coil support structure.

FIG. 12 shows another example of conveying the stacked core section 7A onto the support structure of the transformer, in which the elongated beam 25 is extended at both ends to have extentions 25b supported by wire ropes 25d connected to a crane (not shown). The length of the extention 25b is larger than the width of the coil 3 so that the beam extention 25b can be first inserted into the coil window 4 and suspended by the wire ropes 25d and still the beam 25 projects from the coil 3 with sufficient length for mounting the stacked core section 7A.

In this embodiment, it is seen that the lower ends of the fastening bolts 22 are screwed into the support beam 5 so that the latter serves as the first support member 5a shown in FIG. 11 during the conveying step. According to this embodiment, the support beam should not be removed and should be assembled in the transformer. In other respects, the steps and the arrangement are the same as those explained in the conveying step explained in conjunction with FIG. 11.

Figure 13:
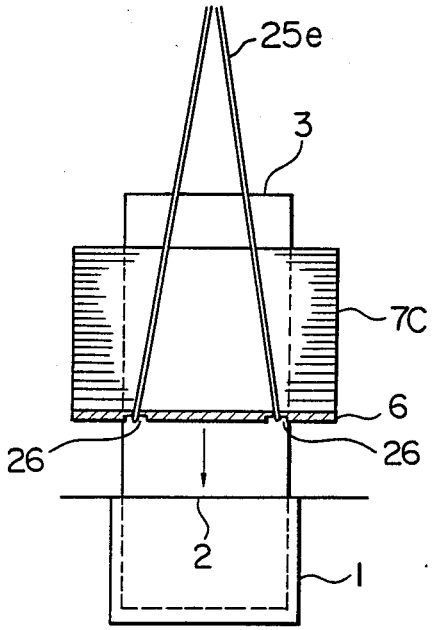
FIG. 13 is a side view illustrating another example of the step of conveying and placing the core section sub-assembly on the coil support structure.

In FIG. 13, an example of the method for conveying the stacked core section 7C to be mounted on the flange 2 of the tank 1 extending outside of the coil 3 is illustrated. It is seen that the spacer 6 having grooves 26 for allowing insulating oil to flow in the transformer tank is placed under the stacked core section 7C. This sub-assembly is suspended by wire ropes 25e from an unillustrated hoist so that the sub-assembly can be easily conveyed and placed at the desired precise position on the support structure of the transformer.

As has been described, according to the present invention a process for assembling a laminated iron core on a support structure about an electric coil from a plurality of laminations to form a magnetic core for a shell-type static induction apparatus is provided. According to the process, the plurality of laminations are stacked in a staggered relationship to form a first core section which has joint ends to form overlapping joints between an adjacent core section, and the first core section is then conveyed onto the support structure at which the iron core is to be assembled. Then a plurality of laminations are inserted between the joints in site to form a second core section which connects the joint ends of the first core section to define a magnetic circuit around the coil.

Accordingly, the process for assembling a laminated iron core for a static induction apparatus can be simply and easily carried out. Also, the assembly of a laminated iron core for a static induction apparatus can be assembled in a short time with precision.

What is claimed is:

1. A process for assembling a laminated iron core on a support structure about an electrical coil from a plurality of lamination sections to form a shell-type transformer core comprising the steps of:

stacking a plurality of lamination sections on a support structure in a staggered relationship to form a first core section which has joint ends to form overlapping joints between an adjacent core section;

conveying said first core section onto said support structure at which a laminated iron core is to be assembled; and assembling the plurality of lamination sections on site into a second core section which connects said joints ends of said first core section to define a magnetic circuit around said coil;

wherein said step of stacking said first core section comprises preparing a first support member, placing a slider sheet of a low coefficient of friction on said first support member, and stacking said lamination sections on said slider sheet; and said conveying step comprises sliding and placing said first core section together with said slider sheet onto said support structure.

2. A process for assembling an iron core as claimed in claim 1, wherein said iron core is a shell-type iron core.

3. A process for assembling an iron core as claimed in claim 1 wherein said step of stacking includes stacking the lamination sections such that the first core section is a leg of said iron core.

4. A process for assembling an iron core as claimed in claim 1 wherein said step of stacking includes stacking each of said lamination sections of said first core section in a staggered manner.

5. A process for assembling an iron core as claimed in claim 1 wherein said step of stacking includes stacking the lamination sections of said first core section such that the lamination sections are staggered in groups of at least two.

6. A process for assembling a lamination iron core on a support structure about an electrical coil from a plurality of lamination sections to form a shell-type transformer core comprising the steps of:

stacking a plurality of lamination sections on a support structure in a staggered relationship to form a first core section which has joint ends to form overlapping joints between an adjacent core section;

conveying said first core section onto said support structure at which a laminated core is to be assembled; and assembling the plurality of lamination sections on site into a second core section which connects said joints ends of said first core section to define a magnetic circuit around said coil;

wherein said step of stacking said first core section comprises preparing a first support member, placing a slider sheet of a low coefficient of friction on said first support member, and stacking said lamination sections on said slider sheet; and said conveying step comprises conveying and placing said first core section together with said slider sheet onto said support structure with said slider sheet between said first core section and said first support structure and pulling out said slider sheet to cause said first core section to directly sit on said support structure.

7. A process for assembling a laminated iron core on a support structure about an electrical coil from a plurality of lamination sections to form a shell-type transformer core comprising the steps of:

stacking a plurality of lamination sections on a support structure in a staggered relationship to form a first core section which has joint ends to form overlapping joints between an adjacent core section;

conveying said first core section onto said support structure at which a laminated core is to be assembled; and assembling the plurality of lamination sections on site into a second core section which connects said joint ends of said first core section to define a magnetic circuit around said coil;

wherein said step of stacking said first core section comprises preparing a first support member, placing a slider sheet of a low coefficient of friction on said first support member, and stacking said lamination sections on said slider sheet; and said conveying step comprises placing a second support member on said slider sheet to form a sub-assembly of said first core section with said slider sheet sandwiched between said first and second support members, turning said sub-assembly upside down, and conveying said sub-assembly onto said support structure.

8. A process for assembling an iron core as claimed in claim 7 wherein said conveying step further comprises removing said first support member from the top of said sub-assembly, conveying and placing said slider sheet and said first core section on said slider sheet onto said support structure.

9. A process for assembling an iron core as claimed in claim 8 wherein said conveying step further comprises pulling out said slider sheet from between said first core section and said support structure.

10. A process for assembling a laminated iron core on a support structure about an electrical coil from a plurality of lamination sections to form a shell-type transformer core comprising the steps of:

stacking a plurality of lamination sections on a support structure in a staggered relationship to form a first core section which has joint ends to form overlapping joints between an adjacent core section;

conveying said first core section onto said support structure at which a laminated core is to be assembled; and assembling the plurality of lamination sections on site into a second core section which connects said joint ends of said first core section to define a magnetic circuit around said coil;

wherein said step of stacking said first core section comprises preparing a first support member, placing a slider sheet of a low coefficient of friction on said first support member, and stacking said laminations on said slider sheet; and said conveying step comprises placing a second support member on said slider sheet to form a sub-assembly of said first core section and said slider sheet sandwiched between said first and second support members, fastening said first and second support members to each other, attaching said second support member to an elongated beam which can be inserted, with said sub-assembly attached thereto, within the coil, and conveying and placing said sub-assembly onto said support structure by moving said elongated beam.

* * * * *